United States Patent [19]

Grochowski

[11] 4,195,822

[45] Apr. 1, 1980

[54] CAR FOR TRANSPORTING A LADLE OF HOT METAL AND CHARGING THE METAL TO A FURNACE

[75] Inventor: Walter Z. Grochowski, Bethel Park, Pa.

[73] Assignee: United States Steel Corporation, Pittsburgh, Pa.

[21] Appl. No.: 903,344

[22] Filed: May 5, 1978

[51] Int. Cl.[2] ..... C21B 3/10

[52] U.S. Cl. ..... 266/165; 105/274; 222/604; 266/240; 266/276

[58] Field of Search ..... 105/264, 265-267, 105/270, 275; 214/18 R; 222/604, 605; 266/142, 143, 158, 165, 240, 276

[56] References Cited

U.S. PATENT DOCUMENTS

| | | | |
|---|---|---|---|
| 564,770 | 7/1896 | Aiken | 222/604 |
| 723,094 | 3/1903 | Wellman | 266/276 |
| 1,608,801 | 11/1926 | Masel et al. | 256/165 |
| 1,629,184 | 5/1927 | Thomas | 222/604 |
| 3,415,421 | 12/1968 | Britcher | 214/18 R |
| 3,877,612 | 4/1975 | Rokop et al. | 266/142 |
| 4,072,299 | 2/1978 | Calderon | 266/142 |
| 4,099,709 | 7/1978 | Calderon | 266/158 |

*Primary Examiner*—Paul A. Bell
*Attorney, Agent, or Firm*—Walter P. Wood

[57] ABSTRACT

A car for transporting a ladle of hot metal and charging the metal to a furnace, commonly a BOP or Q-BOP used in steelmaking. The car includes a transversely movable trolley which carries a tiltable support for a ladle. Tilting of the ladle is independent of transverse movement of the trolley. Thus the car can be positioned adjacent the furnace, and the ladle moved tranversely and tilted to dump its contents into the furnace even though the furnace itself is not tilted to a precise position.

2 Claims, 4 Drawing Figures

CAR FOR TRANSPORTING A LADLE OF HOT METAL AND CHARGING THE METAL TO A FURNACE

This invention relates to an improved car for transporting a ladle of hot metal and charging the metal to a furnace.

The invention is particularly useful for charging hot metal to an oxygen steelmaking furnace, which may be either top blown or bottom blown, known in the art as a BOP or Q-BOP furnace respectively. The most common practice in charging a BOP or Q-BOP furnace is to employ an overhead crane to carry a ladle of hot metal to a position above the furnace. The furnace is tilted, and the main and auxiliary hoists of the crane are operated to tilt the ladle and dump the metal into the furnace. This practice has a number of disadvantages. A large volume of hot gas is emitted from the furnace when it is tilted and envelops the crane which is immediately above. The main trolley machinery and the electrical equipment are exposed to flames and likely to be damaged. The same crane is used also for charging scrap, handling slag pots, handling ladles, clean-up work, and miscellaneous maintenance functions. Hence it is in almost constant use and very little time is available for maintenance. Overhead transfer of ladles filled with hot metal would be a safety hazard to personnel working on the charging floor. Hence safety rules require interruption of work and clearing a path whenever a hot metal ladle is transported overhead.

Prior to my invention it was known to employ a car for transporting hot metal ladle and tilting the ladle to charge the furnace, but cars used heretofore are not altogether satisfactory. When the car is positioned in front of the furnace and the ladle is tilted to dump the hot metal, the ladle is subjected to two simultaneous motions: a curvilinear translation that brings the ladle closer to the furnace and a rotary motion that tilts the ladle. The two motions are intimately coupled; that is, for every inch of translation, there is a fixed angle of rotation. Hence the ladle must be tilted to exactly the right position to receive the hot metal, or spills result.

An object of the present invention is to provide an improved hot metal transport and charging car which overcomes difficulties encountered in prior practice, either in using a crane to transport and charge the metal or in using a car of the type known heretofore.

A further object is to provide an improved car which accomplishes the foregoing object and which allows a ladle carried thereon to move transversely and to tilt independently of its transverse movement, whereby hot metal can be charged to the furnace without need for precision in the position to which the furnace is tilted.

Figure 1:
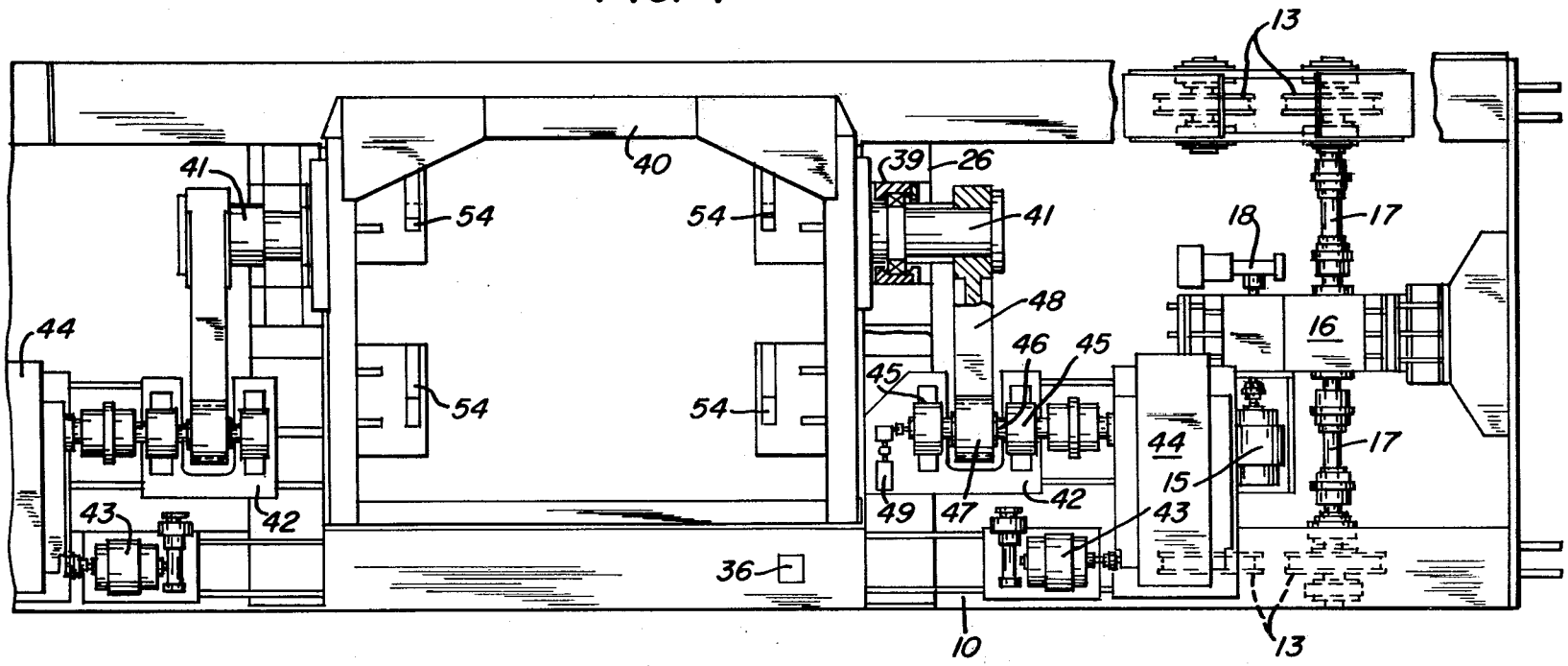
FIG. 1 is a top plan view of a car constructed in accordance with my invention, certain parts being omitted for clarity.
Figure 2:
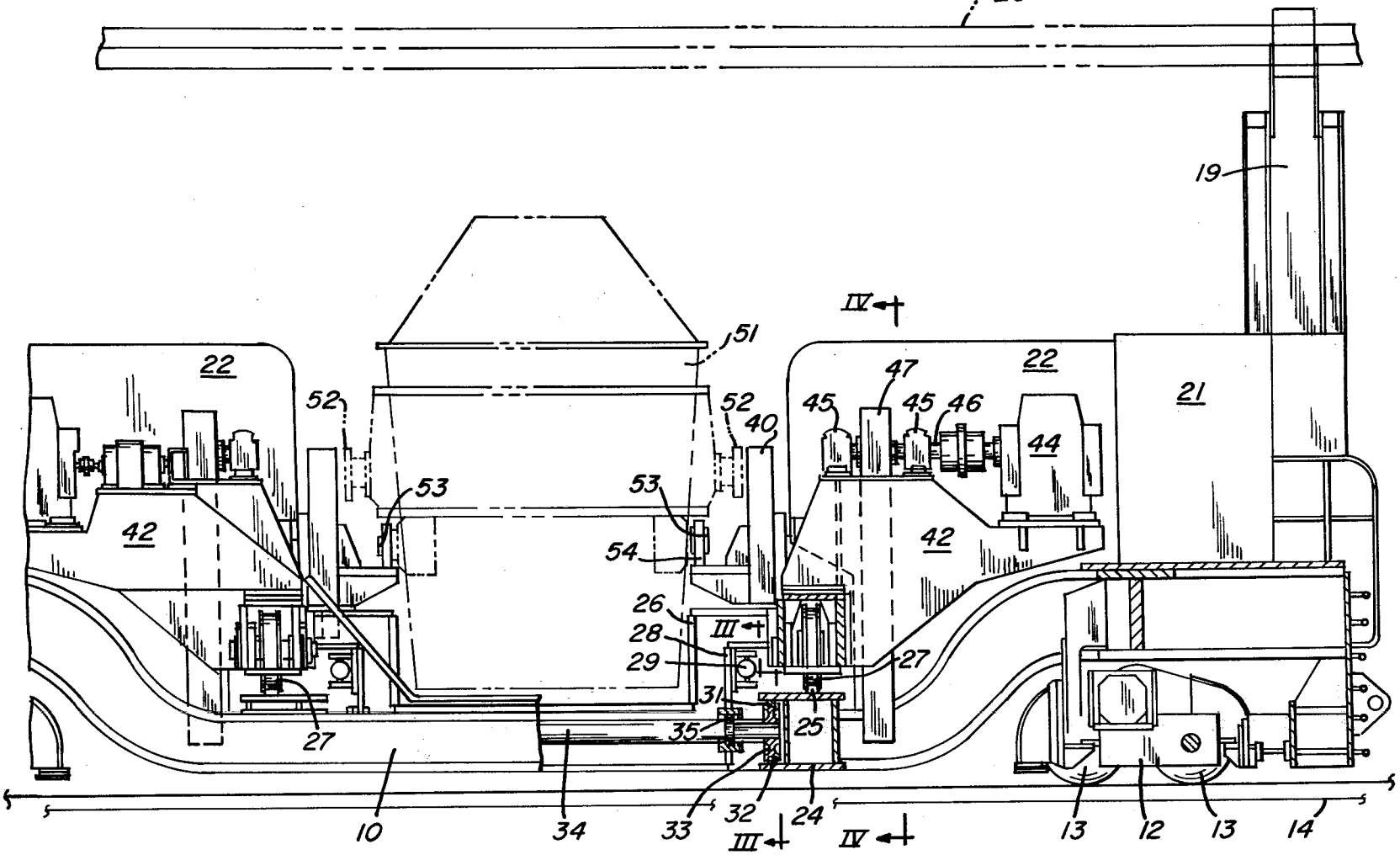
FIG. 2 is a front elevational view of the car and a ladle carried thereon.
Figure 4:
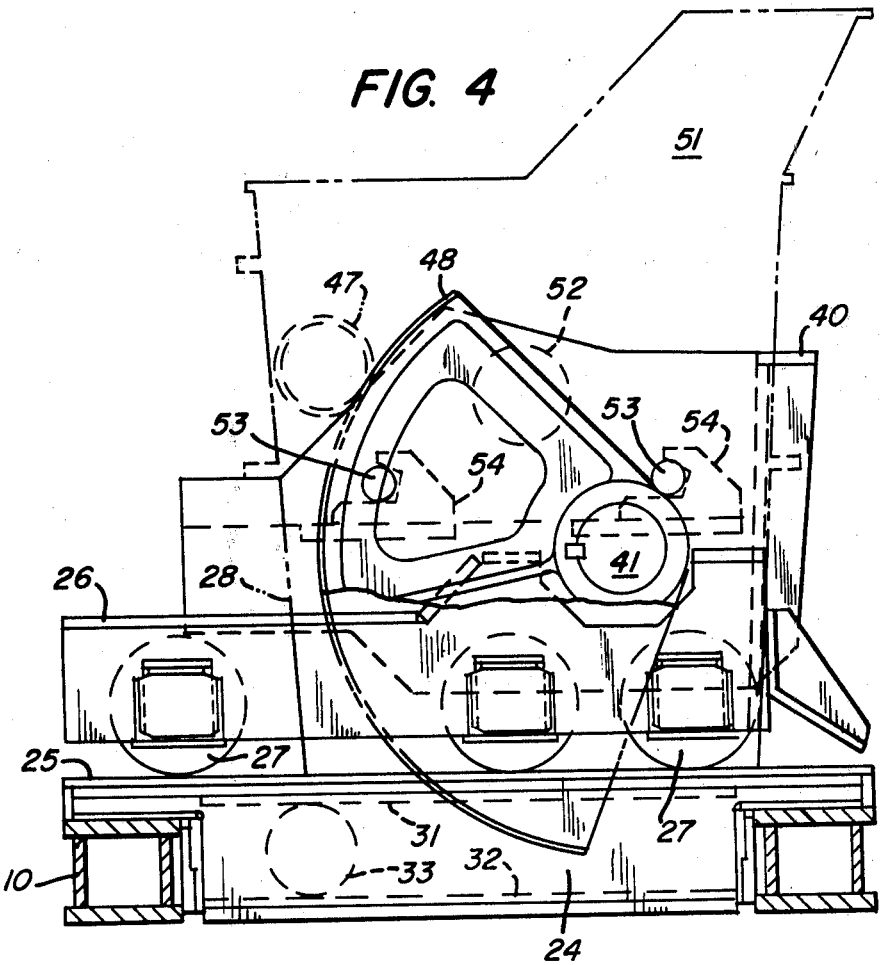

FIG. 4 is a vertical section on line IV—IV of FIG. 2. To enable FIGS. 1 and 2 to be on a larger scale, I omit any showing of a portion of the car at the left end. The structure not shown is substantially a duplication of the structure shown at the right end.

The car of the present invention comprises a main frame 10 and trucks 12 at opposite ends to which wheels

13 are journaled to run on rails 14. Preferably the car is self-propelled and has main drives near both ends. The main drive shown includes a motor 15, gear reducer 16 and shafts 17 connected to two of the wheels 13 at opposite sides of the car. Preferably the drive includes a magnetic brake 18. The car carries a mast 19 which engages overhead collector rails 20 for energizing the electrically operated parts including the drive motor 15. The car has an electrical equipment room 21 beneath the mast. Preferably the main frame carries heat shields 2 which extend along its back edge to protect parts from direct exposure to the heat of a furnace. The mast and heat shields are omitted from FIG. 1 for clarity, but are shown in FIG. 2.

Figure 3:
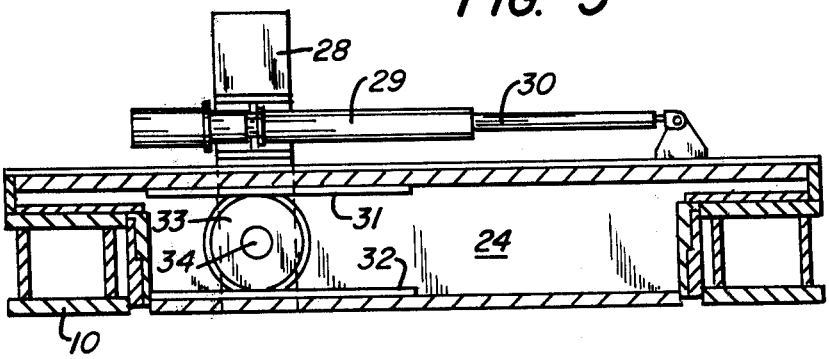
FIG. 3 is a vertical section on line III—III of FIG. 2.

The central portion of the main frame 10 is lower than the end portions and carries a pair of spaced-apart transversely extending structural members 24. These members support transversely extending rails 25. A trolley 26 has wheels 27 which ride on rails 25, whereby the trolley is movable transversely of the car between a ladle-transporting position centrally of the car and a charging position toward the back of the car. As shown in FIGS. 2 and 3, the trolley has a pair of spaced-apart depending legs 28 which are located near the front and to which respective double-acting fluid pressure cylinders 29 are attached. The cylinders contain reciprocating pistons and piston rods 30 which are attached to the main frame 10. Thus the cylinders provide a motive means for moving the trolley transversely of the car. The structural members 24 contain upper and lower tracks 31 and 32 beneath the rails 25. A pair of hold-down wheels 33 are mounted on a shaft 34 which extends lengthwise of the car and is journaled in bearings 35 mounted on legs 28. The hold-down wheels ride on tracks 31 and 32 to prevent the trolley from tipping when the parts are in a charging position as hereinafter described. Preferably the drive is equipped with a limit switch 36 to prevent the trolley from overrunning the rails.

The upper face of trolley 26 carries a pair of aligned bearings 39 located near its back edge (FIG. 1). A ladle support 40 has stub shafts 41 journaled in bearings 39, whereby the ladle support can be tilted between an upright ladle-transporting position, and an inclined charging position. The trolley includes shelves 42 which extend from each end and on which are mounted drives for tilting the ladle support. These drives include respective drive motors 43, gear reducers 44, and aligned pairs of bearings 45. Respective pinion shafts 46 are journaled in bearings 45 and carry pinions 47 (FIG. 4). The stub shafts 41 carry respective gear segments 48 which mesh with pinions 47. Preferably the drive means are equipped with limit switches 49 to prevent the pinions from overrunning the gear segments.

FIGS. 2 and 4 show a ladle 51 mounted on the ladle support 40. The ladle has trunnions 52 which a crane can engage for lifting the ladle and positioning it on the support. Below the trunnions on each side the ladle has a respective pair of pins 53 (four in all). The ladle support has hook shaped brackets 54 which fit over the pins 53 to hold the ladle on the support.

In operation, the car is moved to an appropriate position away from a steelmaking furnace, and a crane is used to place a ladle 51 of hot metal on the ladle support 40. At this time the trolley 26 and ladle support 40 are in their ladle-transporting positions in which cylinders 29 are extended in relation to their piston rods 30 and pinions 47 engage gear segments near the upper ends of the arcs, as shown in FIGS. 3 and 4 respectively. The car is propelled to a position in which its back side is adjacent a steelmaking furnace (not shown). Meanwhile the furnace has been tilted to receive the hot metal. The cylinders 29 are retracted with respect to their piston rods 30 to move the trolley 26 transversely back toward the furnace to a charging position. The motors 43 are operated to tilt the ladle support 40 and ladle 51 back toward the furnace and thus charge the hot metal from the ladle to the furnace.

From the foregoing description it is seen that the present invention provides a ladle-transporting and charging car in which the tilting movement of the ladle support and ladle is entirely independent of the transverse movement to position the ladle close to a furnace. Consequently it is not necessary to tilt the furnace to a precise position to enable it to be charged. The independent motions which the car provides give sufficient flexibility that the furnace is easily charged in a variety of tilted positions. At the same time the invention overcomes difficulties encountered when the furnace is charged from a ladle carried by a crane.

I claim:

1. A rail-mounted car for transporting a ladle of hot metal and charging the metal to a furnace, said car having front and back sides and being movable to a charging position in which its back side is adjacent a furnace, said car comprising:

a main frame having end portions and a central portion lower than said end portions;

a pair of spaced-apart transversely extending structural members carried by the central portion of said frame;

respective transversely extending rails and upper and lower tracks carried by said structural members;

a trolley having wheels riding on said rails and hold-down wheels riding on said tracks;

at least one fluid pressure cylinder and piston connected between said frame and said trolley for moving said trolley transversely of said frame between ladle-transporting and charging positions;

a ladle support mounted on said trolley;

at least one gear segment connected with said ladle support;

a pinion journaled on said trolley and engaging said gear segment;

drive means on said trolley operatively connected with said pinion for tilting said ladle support sideways of the car between an upright ladle-transporting position and an inclined charging position independently of transverse movement of said trolley; and self-propelled driving means for said car mounted on said frame.

2. A car as defined in claim 1 in which said ladle support includes hook-shaped brackets adapted to fit over pins on the ladle to hold the ladle on the support.

* * * * *